US008500239B2

(12) United States Patent
Kato et al.

(10) Patent No.: US 8,500,239 B2
(45) Date of Patent: Aug. 6, 2013

(54) RECORDING APPARATUS AND CONVEYANCE MEMBER USED THEREFOR

(75) Inventors: Shigeki Kato, Toyoake (JP); Kengo Takeda, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/338,208

(22) Filed: Dec. 27, 2011

(65) Prior Publication Data

US 2012/0162313 A1 Jun. 28, 2012

(30) Foreign Application Priority Data

Dec. 28, 2010 (JP) ..... 2010-292506

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS 4,844,632 A * 7/1989 Minowa ..... 400/120.17
5,225,852 A * 7/1993 Uchida et al. ..... 346/134
7,040,734 B2 * 5/2006 Nakashima et al. ..... 347/33
2002/0163554 A1 * 11/2002 Takahashi ..... 347/33
2011/0292100 A1 * 12/2011 Takeda et al. ..... 347/1

FOREIGN PATENT DOCUMENTS

JP H04-303628 A 10/1992
JP H07-178839 A 7/1995
JP 2005-082327 A 3/2005
JP 2006-206279 A 8/2006
JP 2008-238677 A 10/2008
JP 2009-000772 A 1/2009

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A recording apparatus including: a recording portion configured to record an image on a recording medium; an annular conveyance member having a face opposed to the recording portion, the face being capable of moving in a circumferential direction of the annular conveyance member while supporting the recording medium to convey the recording medium; and a first wiper configured to wipe the face by moving relative to the face, while contacting the face, in an intersecting direction that intersects the circumferential direction, wherein the face has a first area as a part of the face, the first area being an area at least a part of which is wiped by the first wiper, the first area having a grinding mark extending in the intersecting direction.

16 Claims, 9 Drawing Sheets

RECORDING APPARATUS AND CONVEYANCE MEMBER USED THEREFOR

CROSS REFERENCE TO RELATED APPLICATION

The present application claims priority from Japanese Patent Application No. 2010-292506, which was filed on Dec. 28, 2010, the disclosure of which is herein incorporated by reference in its entirety.

BACKGROUND

1. Field of the Invention

The present invention relates to a recording apparatus configured to record an image on a recording medium and a conveyance member used in the recording apparatus.

2. Description of the Related Art

There is known a technique (a wiping technique) of a recording apparatus for removing foreign matters (such as liquid (e.g., ink) and paper dust) from a face of an annular conveyance member by a wiper. For example, in a conventional technique, foreign matters on a face of a conveyance belt (as a conveyance member) are removed by a blade (as a wiper) in an ink-jet recording apparatus (as a recording apparatus). In the wiping, the blade is moved in a direction intersecting a circumferential direction of the conveyance belt while being held in contact with the face of the conveyance belt.

SUMMARY

Meanwhile, the face of the annular conveyance member is generally ground in its manufacturing process in order to reduce a surface roughness. A large surface roughness lowers a conveyance accuracy and an adsorptive holding force of the conveyance member and deteriorates an efficiency of removing foreign matters by the wiper. In a grinding step, the conveyance member is rotated in its circumferential direction in a state in which a grindstone or a buff is held in contact with the face of the conveyance member, for example. This makes it possible to easily grind the entire face of the conveyance member. As a result of this grinding, grinding marks (polishing lines) extending in the circumferential direction are formed in the face of the conveyance member.

However, in the conventional technique, the direction of the movement of the wiper is the direction intersecting the circumferential direction. Thus, if the grinding marks extending in the circumferential direction are formed in the face of the conveyance member, the foreign matters disadvantageously enter into the grinding marks in the wiping because the direction of the movement of the wiper intersects the direction in which the grinding marks extend. This may cause a problem that good wiping is unable to be performed.

This invention has been developed in view of the above-described situations, and it is an object of the present invention to provide a recording apparatus and a conveyance member used for the recording apparatus each of which can perform good wiping in a construction in which a wiper is moved relative to a face of an annular conveyance member in a direction intersecting a circumferential direction of the conveyance member.

The object indicated above may be achieved according to the present invention which provides a recording apparatus including: a recording portion configured to record an image on a recording medium; an annular conveyance member having a face opposed to the recording portion, the face being capable of moving in a circumferential direction of the annular conveyance member while supporting the recording medium to convey the recording medium; and a first wiper configured to wipe the face by moving relative to the face, while contacting the face, in an intersecting direction that intersects the circumferential direction, wherein the face has a first area as a part of the face, the first area being an area at least a part of which is wiped by the first wiper, the first area having a grinding mark extending in the intersecting direction.

The object indicated above may be achieved according to the present invention which provides an annular conveyance member having a face disposed so as to be opposed to a recording portion configured to record an image on a recording medium, wherein the annular conveyance member is configured such that the face moves in a circumferential direction of the annular conveyance member while supporting the recording medium to convey the recording medium, and wherein the face has a first area as a part of the face, the first area being an area at least a part of which is wiped by a wiper in an intersecting direction that intersects the circumferential direction, the first area having a grinding mark extending in the intersecting direction.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
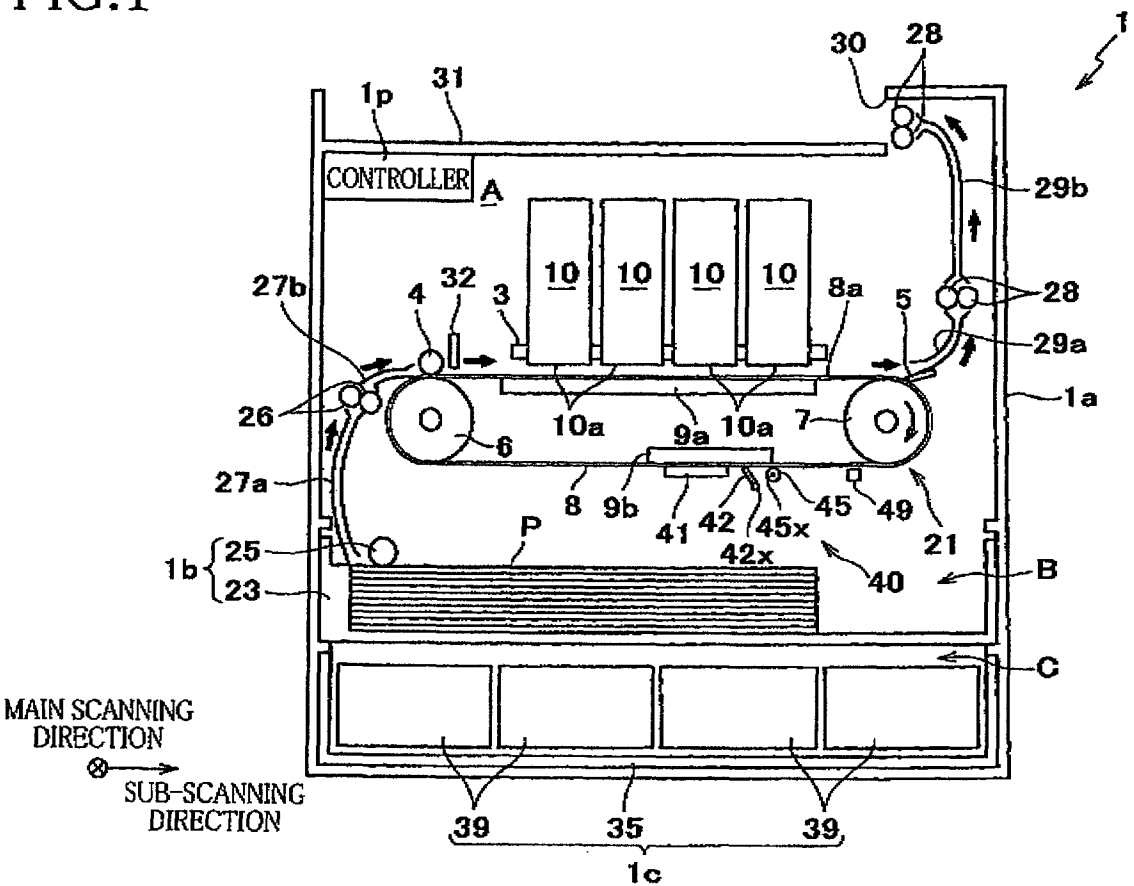
FIG. 1 is a side view generally showing an internal construction of an ink-jet printer as one embodiment of a recording apparatus of the present invention.

First, there will be explained an overall construction of an ink-jet printer 1 as one embodiment of the present invention with reference to FIG. 1.

The printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from an upper side thereof. A sheet-supply unit 1*b* is disposed in the space B. In the spaces A and B, there is formed a sheet conveyance path extending from the sheet-supply unit 1*b* to the sheet-discharge portion 31.

In the space A, there are disposed a sheet sensor 32, four heads 10, a conveyance unit 21, a guide unit, a wiping unit 40, a controller 1*p*, and so on.

The conveyance unit 21 includes: belt rollers 6, 7; an endless conveyance belt 8 wound around the rollers 6, 7; a nip roller 4 and a peeling plate 5 disposed outside the conveyance belt 8; platens 9*a*, 9*b* disposed inside the conveyance belt 8; and so on. The belt roller 7 is a drive roller that is rotated in a clockwise direction in FIG. 1 by a conveyance motor 121 (see FIG. 8). In accordance with the rotation of the belt roller 7, the conveyance belt 8 rotates or moves in its circumferential direction to run in a direction indicated by bold arrows in FIG. 1. The belt roller 6 is a driven roller that is rotated in the clockwise direction in FIG. 1 in accordance with the rotation of the conveyance belt 8. The nip roller 4 is disposed so as to face the belt roller 6 and used for pressing a sheet P (as one example of a recording medium) supplied from an upstream-side guide portion (which will be explained below), onto a face 8*a* of the conveyance belt 8. The peeling plate 5 is disposed so as to face the belt roller 7 and used for peeling the sheet P from the face 8*a* to guide the sheet P toward a downstream-side guide portion (which will be explained below). The platen 9*a* is disposed so as to face the four heads 10 and to support an upper portion (an upper loop) of the conveyance belt 8 from an inside thereof. As a result, a predetermined space appropriate for recording is formed between the face 8*a* and lower faces (ejection faces 10*a*) of the respective heads 10.

Each head 10 (as one example of a recording portion) is a line head having a generally rectangular parallelepiped shape elongated in a main scanning direction. In recording (forming an image), the four heads 10 respectively eject inks of four colors, namely, magenta, cyan, yellow, and black, from the lower faces (the ejection faces 10*a*) thereof. The four heads 10 are arranged in a sub-scanning direction (perpendicular to the main scanning direction) at predetermined pitches and supported by the casing 1*a* via a frame 3.

The guide unit includes the upstream-side guide portion and the downstream-side guide portion disposed on opposite sides of the conveyance unit 21. The upstream-side guide portion includes two guides 27*a*, 27*b* and a pair of conveyance rollers 26. The upstream-side guide portion connects the sheet-supply unit 1*b* and the conveyance unit 21 to each other. The downstream-side guide portion includes two guides 29*a*, 29*b* and two pairs of conveyance rollers 28. The downstream-side guide portion connects the conveyance unit 21 and the sheet-discharge portion 31 to each other.

The wiping unit 40 includes a first wiper 41 (as one example of a first wiper), a second wiper 42 (as one example of a second wiper), a first wiper cleaner 44 (see FIG. 6), a second wiper cleaner 45, and a sensor 49. The second wiper 42, the second wiper cleaner 45, and the sensor 49 are disposed so as to face the face 8*a* of a lower portion (a lower loop) of the conveyance belt 8. The first wiper 41 is normally located at a home position (see FIG. 5) that is one of opposite sides of the lower portion of the conveyance belt 8 in the main scanning direction, and during wiping, the wiper 41 is moved in the main scanning direction while being held in contact with the face 8*a* of the lower portion. The first wiper cleaner 44 (see FIG. 6) is disposed on the other of the opposite sides of the lower portion of the conveyance belt 8 in the main scanning direction (that is, the first wiper cleaner 44 is disposed on a side of the lower portion that is different from a side thereof on which the home position of the first wiper 41 is located). A platen 9*b* is disposed inside the conveyance belt 8 and on a back side of a portion of the conveyance belt 8 which portion is contacted by the wipers 41, 42 during the wiping. The platen 9*b* supports the lower portion of the conveyance belt 8 from an inside thereof, making it possible to prevent the conveyance belt 8 from being deformed by pressing forces of the wipers 41, 42 during their wiping, which ensures satisfactory wiping.

The sheet-supply unit 1*b* includes a sheet-supply tray 23 and a sheet-supply roller 25. The sheet-supply tray 23 is mountable on and removable from the casing 1*a*. The sheet-supply tray 23 has a box shape opening upward and can accommodate various sizes of sheets P. The sheet-supply roller 25 supplies, to the upstream-side guide portion, an uppermost one of the sheets P in the sheet-supply tray 23.

The controller 1*p* controls operations of the components of the printer 1 to control entire operations of the printer 1.

In order to record an image on the sheet P on the basis of image data supplied from an external device such as a PC connected to the printer 1, the controller 1*p* controls: a preliminary operation for the recording; the supplying, conveying, and discharging of the sheet P; an ink ejecting operation synchronized with the conveyance of the sheet P; and so on. Specifically, on the basis of a recording command received from the external device, the controller 1*p* controls driving devices for driving: a sheet-supply motor 125 (see FIG. 8) for the sheet-supply roller 25; a conveyance motor 127 (see FIG. 8) for the conveyance rollers of the guide portions; the conveyance motor 121 (see FIG. 8), the heads 10; and so on. The sheet P supplied from the sheet-supply tray 23 is conveyed to the conveyance unit 21 by the conveyance rollers 26. When the sheet P passes through a position just under the heads 10 in the sub-scanning direction, the heads 10 respectively eject inks of respective colors to form a color image on the sheet P. The ink ejecting operation for the recording is performed on the basis of a detection signal transmitted from the sheet sensor 32 for sensing a leading end of the sheet P. The sheet P is then peeled from the peeling plate 5 and conveyed upward by the two conveyance rollers 28. Further, the sheet P is discharged onto the sheet-discharge portion 31 through an opening 30 formed in an upper portion of the printer 1.

Here, the sub-scanning direction is a direction parallel to a horizontal plane and parallel to a direction (a part of a conveyance direction) in which the sheet P conveyed by the conveyance unit 21 is conveyed through the position opposed to the heads 10, and the main scanning direction is a direction parallel to the horizontal plane and perpendicular to the sub-scanning direction.

The controller 1*p* also controls a maintenance operation (which will be described below) for the heads 10 and the conveyance belt 8. The maintenance operation includes: an ink ejection (a preliminary ejection) performed at a timing different from that of the recording; and a wiping for removing foreign matters (such as the ink and paper dust) from the face 8*a* of the conveyance belt 8. The maintenance operation will be explained in more detail.

In the space C, a cartridge unit 1*c* is disposed so as to be mountable on and removable from the casing 1*a*. The cartridge unit 1*c* includes a tray 35 and four cartridges 39 accommodated in the tray 35 side by side. The cartridges 39 respectively store the inks of four colors and respectively communicate with the heads 10 via tubes, not shown. The inks stored in the respective cartridges 39 are supplied to the respective heads 10 at appropriate timings.

Figure 2:
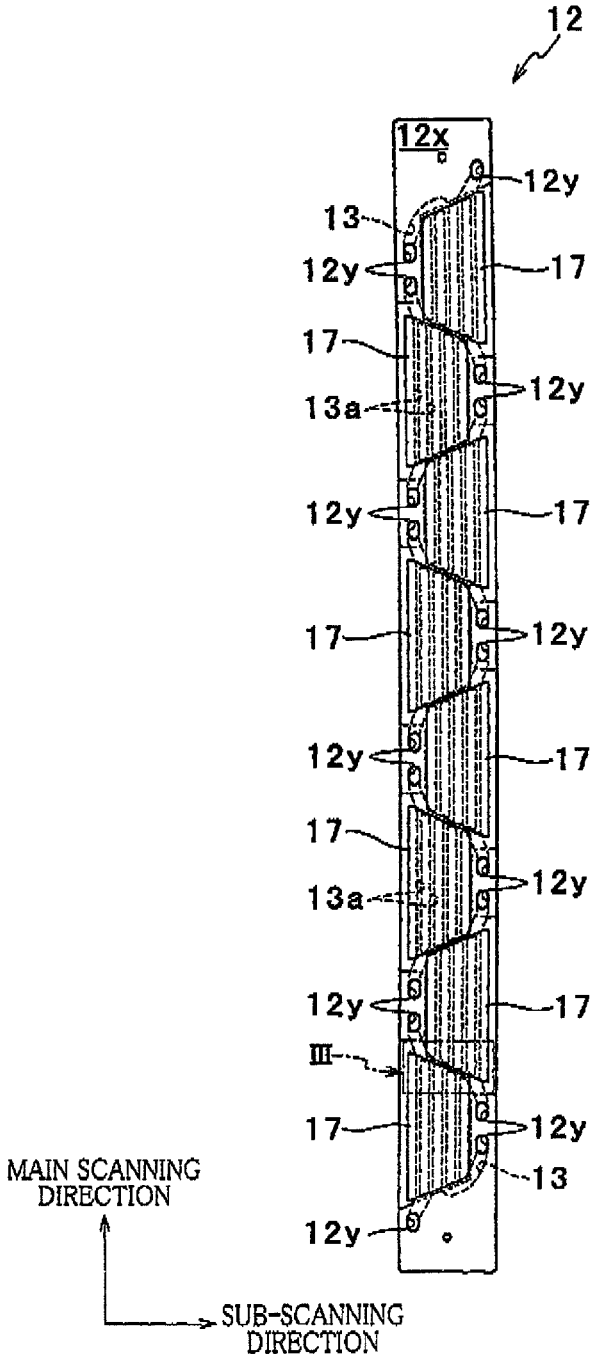
FIG. 2 is a plan view showing a channel unit and actuator units of an ink-jet head of the printer in FIG. 1.
Figure 3:
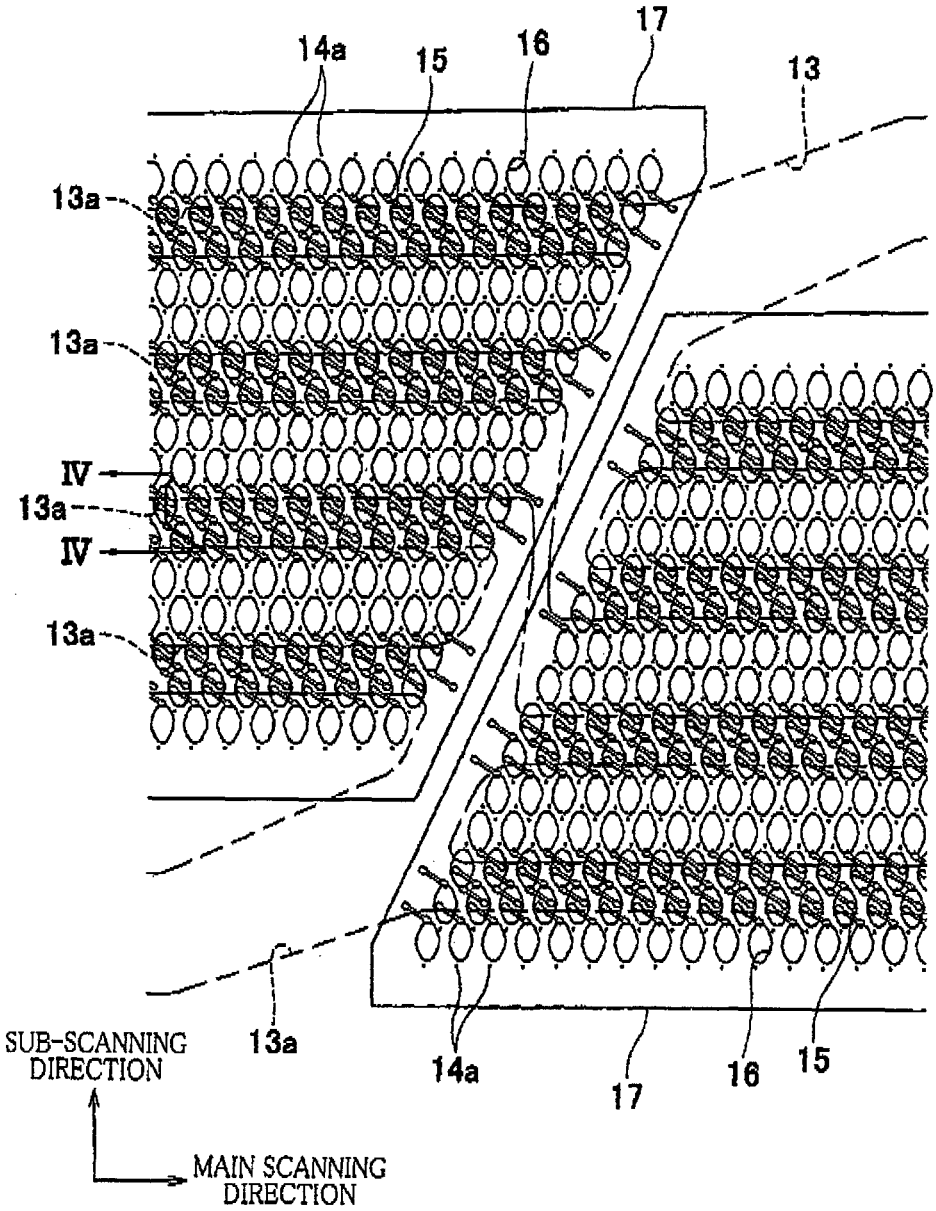
FIG. 3 is an enlarged view showing an area III enclosed by a one-dot chain line in FIG. 2.
Figure 4:
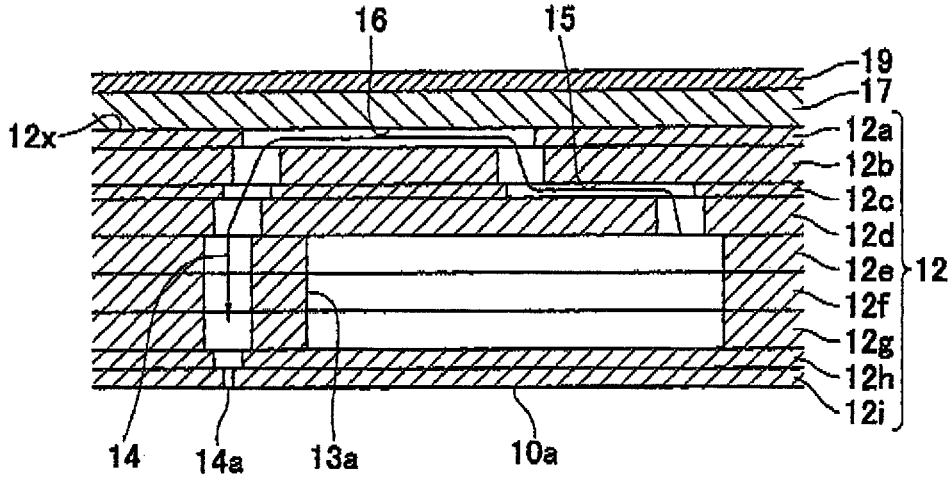
FIG. 4 is a partial cross-sectional view taken along line IV-IV in FIG. 3.

There will be next explained the construction of each head 10 with reference to FIGS. 2-4 in detail. It is noted that, in FIG. 3, pressure chambers 16 and apertures 15 are illustrated by solid lines for easier understanding purposes though these elements are located under the actuator units 17 and thus should be illustrated by broken lines. It is further noted that, since the four heads 10 have the same construction, the following explanation will be given for one of the heads 10 for the sake of simplicity.

The head 10 is a stacked body including: a reservoir unit, not shown; a channel unit 12; eight actuator units 17 fixed to an upper face 12*x* of the channel unit 12 (see FIG. 2); Flexible Printed Circuits (FPCs, see FIG. 4) 19 bonded to the respective actuator units 17; and so on which are stacked in an upward and downward direction. The reservoir unit has a channel including a reservoir for temporarily storing the ink supplied from the cartridge 39 (see FIG. 1). The channel unit 12 has channels each extending from a corresponding one of openings 12*y* (see FIG. 2) formed in the upper face 12*x* to a corresponding one of ejection openings 14*a* formed in the lower face (the ejection face 10*a*). Each of the actuator units 17 has piezoelectric actuators respectively for the ejection openings 14*a*.

Projections and recesses are formed on and in a lower face of the reservoir unit. The projections are bonded to areas of the upper face 12*x* of the channel unit 12 on which the actuator units 17 are not disposed (i.e., areas including the openings 12*y* and enclosed by two-dot chain lines in FIG. 2). A distal end face of each of the projections has an opening connected to the reservoir and opposed to a corresponding one of the openings 12*y* of the channel unit 12. As a result, individual channels 14 and the reservoir are communicated with each other via the above-described openings. The recesses are opposed to the upper face 12*x* of the channel unit 12, surfaces of the actuator units 17, and surfaces of the FPCs 19 with slight clearances therebetween.

The channel unit 12 is a stacked body constituted by nine metal rectangular plates 12*a*-12*i* (see FIG. 4) having generally the same size and bonded to one another. As shown in FIGS. 2, 3, and 4, the channels of the channel unit 12 include (a) manifold channels 13 respectively having the openings 12*y* at respective one ends, (b) sub-manifold channels 13*a* each branched from a corresponding one of the manifold channels 13, and (c) the individual channels 14 each extending from an outlet of a corresponding one of the sub-manifold channels 13*a* to a corresponding one of the ejection openings 14*a* via a corresponding one of the pressure chambers 16. As shown in FIG. 4, each of the individual channels 14 is formed for a corresponding one of the ejection openings 14*a* so as to have the aperture 15 functioning as a restrictor for adjusting a channel resistance. In areas of the upper face 12*x* to which the respective actuator units 17 are bonded, generally rhombic openings respectively for exposing the pressure chambers 16 are formed so as to be arranged in matrix. In areas of the lower face (the ejection face 10*a*) which are respectively opposed to the areas to which the respective actuator units 17 are bonded, the ejection openings 14*a* are formed in matrix in the same pattern as that of the pressure chambers 16.

As shown in FIG. 2, the actuator units 17 each having a trapezoid shape in plan view are arranged on the upper face 12*x* in two arrays in a staggered configuration. As shown in FIG. 3, each of the actuator units 17 covers the openings of the pressure chambers 16 formed in the area to which the actuator unit 17 is bonded. Though not shown in any figures, the actuator unit 17 includes: a plurality of piezoelectric layers expanding over a multiplicity of the pressure chambers 16; and electrodes interposing the piezoelectric layer in a thickness direction of the actuator unit 17. The electrodes include: individual electrodes provided for the respective pressure chambers 16; and a common electrode common for the pressure chambers 16. The individual electrodes are formed on a surface of an uppermost one of the piezoelectric layers.

Each of the FPCs 19 has wirings respectively corresponding to electrodes of the actuator unit 17, and driver ICs, not shown, are mounted on the wirings. One end of the FPC 19 is fixed to the actuator unit 17, and the other end thereof is fixed to a control board, not shown, of the head 10 (which is disposed on an upper side of the reservoir unit). Under the control of the controller 1*p* (see FIG. 1), the FPC 19 sends the driver ICs various drive signals outputted from the control board and sends the actuator units 17 signals produced by the driver ICs.

Figure 5:
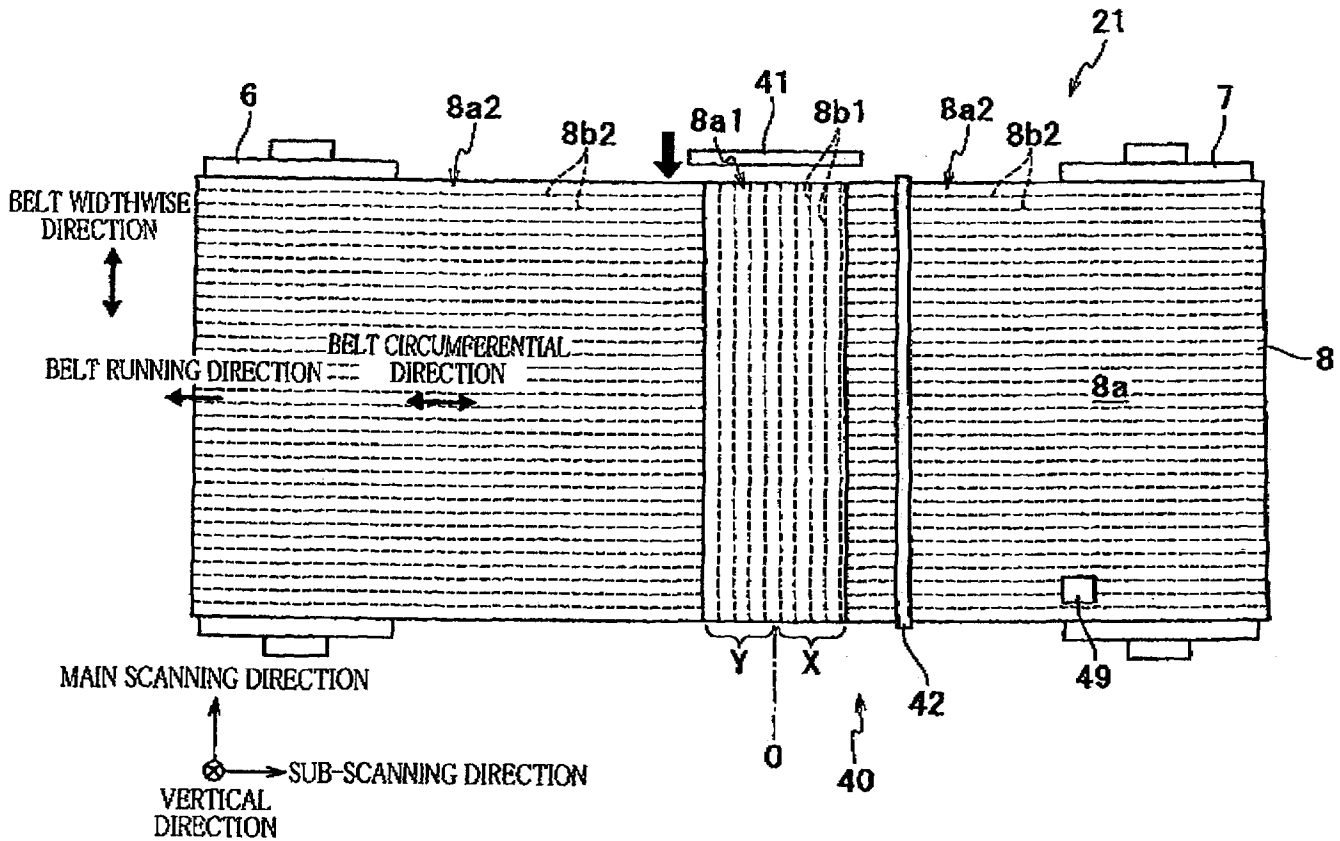
FIG. 5 is a view generally showing a conveyance belt and a wiping unit of the printer in FIG. 1, as seen from a lower side of a lower portion of a conveyance belt.

There will be next explained the structures of the conveyance belt 8 and the wiping unit 40 with reference to FIG. 5, for example. It is noted that, in FIG. 5, only distal ends are illustrated for the wipers 41, 42, and illustrations of the wiper cleaners 44, 45 (see FIG. 6) are omitted.

As shown in FIG. 5, the face 8*a* of the conveyance belt 8 is divided into a first area 8*a*1 and a second area 8*a*2. The first area 8*a*1 is a rectangular area expanding in the circumferential direction of the conveyance belt 8 and in a widthwise direction thereof (i.e., a direction perpendicular to the circumferential direction). The first area 8*a*1 expands from one end to the other end of the conveyance belt 8 in its widthwise direction. A width of the first area 8*a*1 (i.e., a length thereof in the circumferential direction of the conveyance belt 8) is generally the same as a width of the ejection face 10*a* of the head 10 (i.e., a length of the ejection face 10*a* in the circumferential direction), for example. The second area 8*a*2 is an area constituted by an entire area of the face 8*a* except the first area 8*a*1. Grinding marks 8*b*1 (polishing lines) are formed on the first area 8*a*1 so as to extend in the widthwise direction of the conveyance belt 8. In other words, the grinding marks 8*b*1 extend in a direction in which the first area 8*a*1 is ground. Grinding marks 8*b*2 (polishing lines) are formed on the second area 8*a*2 so as to extend in the circumferential direction of the conveyance belt 8. In other words, the grinding marks 8*b*2 extend in a direction in which the second area 8*a*2 is ground. It is noted that, in FIG. 5, the grinding marks 8*b*1, 8*b*2 are illustrated so as to be arranged at relatively large pitches for the sake of clarification, but in reality arranged at pitches in units of microns, and thus the grinding marks 8*b*1, 8*b*2 are difficult to be recognized with naked eyes.

The conveyance belt 8 is manufactured by performing the following molding step and then performing a grinding step, for example.

One of various methods may be employed as the molding step. For example, the methods include (a) a method for molding a material of the conveyance belt 8 (e.g., a resin such as a rubber, a polyimide, and a polycarbonate) into a tubular shape using an annular die and an inner mandrel and cutting the molded material such that the material has a predetermined width, (b) a method for molding a flat sheet, then cutting the molded flat sheet such that the sheet has a predetermined length, and finally bonding opposite end portions of the cut sheet to each other, and (c) a method in which a prepolymer is infused into a circular die, then semi-cured, then removed from the die, and then cured by heating in a state in which the prepolymer is put on an iron core, for example. Normally, a surface of a belt molded in this manner (a precursor of the conveyance belt 8 (hereinafter may be referred to as "belt precursor")) is not completely smooth or flat and has a large surface roughness. The large surface roughness deteriorates a conveyance accuracy, an image transferring accuracy, and an efficiency of removing the foreign matters by the wipers 41, 42. In order to solve this problem, a step for grinding the surface of the belt precursor is performed.

In the grinding step, the belt precursor is wound between and around two rollers, then tensioned by moving the rollers away from each other, and finally circulated in this state by rotating the rollers, for example. When the belt precursor is being circulated, the grindstone or the buff is brought into contact with an area (to be the second area 8*a*2) of the surface of the running belt precursor except an area thereof (to be the first area 8*a*1). As a result, grinding marks extending in a direction of the circulation are formed over the second area 8*a*2. Further, in the state in which the belt precursor is tensioned as described above and the roller is at rest, the grindstone or the buff is moved in a widthwise direction of the belt precursor while contacting the area (to be the first area 8*a*1) of the surface of the belt precursor. As a result, grinding marks extending in the widthwise direction of the belt precursor are formed over the first area 8*a*1.

Each of the first area 8*a*1 and the second area 8*a*2 of the grinded face 8*a* generally has a mirror surface (having a surface roughness Rz that is equal to or lower than 1.5μ, for example). It is noted that the first area 8*a*1 and the second area 8*a*2 have different surface roughnesses from each other, and thus the optical sensor 49 can sense the first area 8*a*1. The surface roughness can be adjusted by a type of the grindstone, a roughness of a grinding agent (abrasive) for the buff, and a pressure of the grindstone or the buff applied to the surface of the belt precursor, for example.

Each of the first wiper 41 and the second wiper 42 of the wiping unit 40 is a plate-like member formed of an elastic material such as a rubber. The first wiper 41 is elongated in the sub-scanning direction, and the second wiper 42 is elongated in the main scanning direction. The first wiper 41 is longer than the first area 8*a*1 in the sub-scanning direction, and the second wiper 42 is longer than the second area 8*a*2 in the main scanning direction. The controller 1*p* controls each of the wipers 41, 42 to be held in contact with the face 8*a* in the corresponding wiping and to be distant from the face 8*a* when the wiping is not performed.

Each of the wiper cleaners 44, 45 (see FIG. 6) is a cylindrical member formed of a material capable of absorbing the ink such as a sponge. The wiper cleaners 44, 45 are used respectively for cleaning the distal ends of the respective wipers 41, 42. The first wiper cleaner 44 is elongated in the sub-scanning direction, and the second wiper cleaner 45 is elongated in the main scanning direction. The first wiper cleaner 44 is longer than the first wiper 41 in the sub-scanning direction, and the second wiper cleaner 45 is longer than the second wiper 42 in the main scanning direction. The wiper cleaners 44, 45 are always located at their respective positions that are distant from the face 8*a*.

Figure 6:
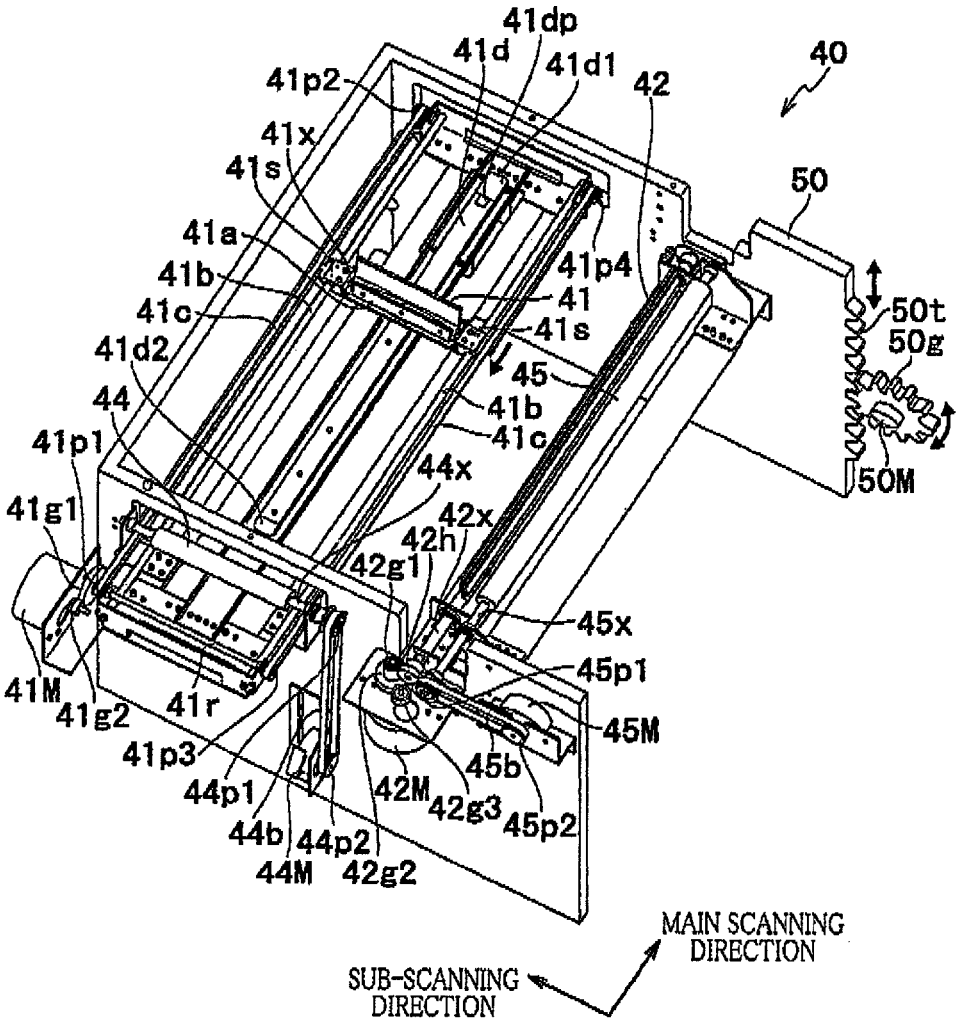
FIG. 6 is a perspective view showing the wiping unit.

Here, there will be explained a mechanism for supporting the wipers 41, 42 and the wiper cleaners 44, 45 with reference to FIG. 6.

Figure 7A:
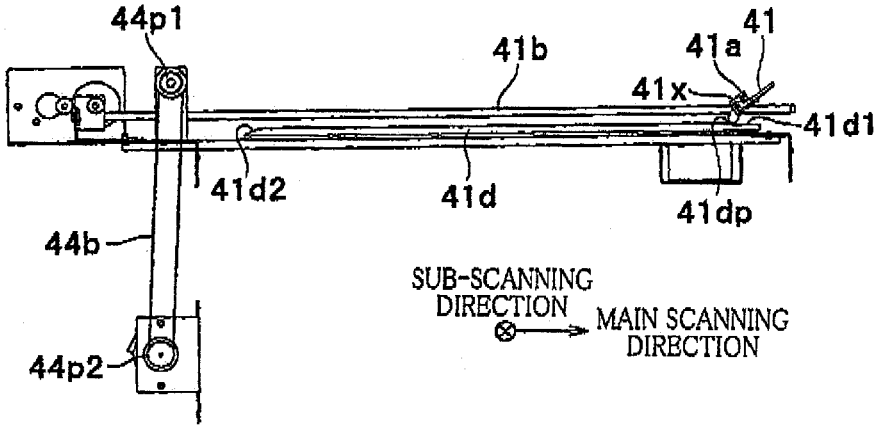
FIGS. 7A-7G are views for explaining an operation of a first wiper during its wiping operation.

A basal end of the first wiper 41 (i.e., an end portion thereof opposite to the distal end thereof) is fixed to a supporter 41*a*. The supporter 41*a* is supported by a shaft 41*x* extending in the sub-scanning direction such that the supporter 41*a* is rotatable about the shaft 41*x*. A pair of sliders 41*s* are respectively provided on opposite ends of the shaft 41*x*. The sliders 41*s* are slidably supported on respective bars 41*b* each extending in the main scanning direction. To each of the sliders 41*s* is fixed a lower portion of a corresponding one of belts 41*c*. One of the belts 41*c* is wound around pulleys 41*p*1, 41*p*2, and the other of the belts 41*c* is wound around pulleys 41*p*3, 41*p*4. The pulleys 41*p*1, 41*p*3 are provided on opposite ends of a roller 41*r*. In addition to the pulley 41*p*1, a gear 41*g*1 rotatable integrally with the pulley 41*p*1 is provided on one of the opposite ends of the roller 41*r*. The gear 41*g*1 is connected to a motor 41M via a gear 41*g*2. When the pulley 41*p*1 is rotated by the motor 41M, the belts 41*c* are circulated. The sliders 41*s* are in turn slid along the bars 41*b*, whereby the supporter 41*a* is moved in the main scanning direction while supporting the first wiper 41. A plate 41*d* extending in the main scanning direction is disposed on a lower side of the supporter 41*a*. During the movement of the first wiper 41 in the main scanning direction, a lower end 41*a*1 of the supporter 41*a* is held in sliding contact with a face of the plate 41*d*. The face of the plate 414 is flat except opposite ends thereof in the main scanning direction. The plate 414 has: a step face 41*d*1 on one of the opposite ends thereof in the main scanning direction (i.e., an upstream end portion in a direction indicated by arrow in FIG. 6 in which the first wiper 41 is moved in its wiping); and an inclined face 41*d*2 on the other of the opposite ends thereof in the main scanning direction. The step face 41*d*1 is lower than the face of the plate 41*d* except the opposite ends thereof in the main scanning direction. A protruding portion 41*dp* is provided on the face of the plate 41*d* at a boundary between the step face 41*d*1 and the other area on the face of the plate 41*d* (except the step face 41*d*1). It is noted that the supporter 41*a* is urged in a clockwise direction in FIG. 7A by an urging member such as a spring.

A shaft 44*x* extending in the sub-scanning is inserted, or fitted in a center of the first wiper cleaner 44 so as to be fixed to the first wiper cleaner 44. A pulley 44*p*1 is provided on one end of the shaft 44*x*. A motor 44M and a pulley 44*p*2 fixed to an output shaft of the motor 44M are disposed on a lower side of the pulley 44*p*1. A belt 44*b* is wound around the pulleys 44*p*1, 44*p*2. When the pulley 44*p*2 is rotated by the motor 44M, the belt 44*b* is circulated, which rotates the pulley 44*p*1 with the shaft 44*x*. As a result, the first wiper cleaner 44 is rotated about the shaft 44*x*.

A basal end of the second wiper 42 (i.e., an end portion thereof opposite to the distal end thereof) is fixed to a shaft 42*x*. A worm wheel 42*h* is provided on one end of the shaft 42*x*. The worm wheel 42*h* is connected to a motor 42M via gears 42*g*1, 42*g*2, 42*g*3. The gears 42*g*3, 42*g*2, 42*g*1 are rotated by the motor 42M, which rotates the worm wheel 42*h* with the shaft 42*x*. This changes an angle of the second wiper 42 with respect to the face 8*a*.

A shaft 45*x* extending in the main scanning direction is inserted or fitted in a center of the second wiper cleaner 45 so as to be fixed to the second wiper cleaner 45. A pulley 45*p*1 is provided on one end of the shaft 45*x*. A motor 45M and a pulley 45*p*2 fixed to an output shaft of the motor 45M are disposed at positions distant from the pulley 45*p*1 in the sub-scanning direction. A belt 45*b* is wound around the pulleys 45*p*1, 45*p*2. When the pulley 45*p*2 is rotated by the motor 45M, the belt 45*b* is circulated, which rotates the pulley 45*p*1 with the shaft 45*x*. As a result, the second wiper cleaner 45 is rotated about the shaft 45*x*.

There will be explained operations of the wipers 41, 42. The first wiper 41 wipes the first area 8*a*1, and the second wiper 42 wipes the second area 8*a*2.

Figure 7B:
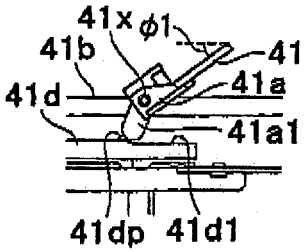
Figure 7C:
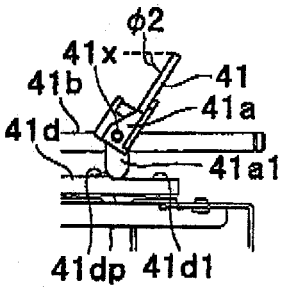
Figure 7D:
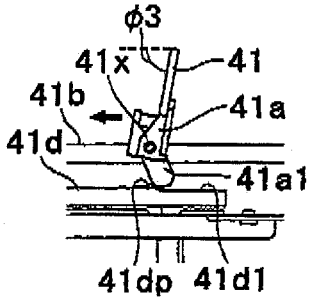
Figure 7E:
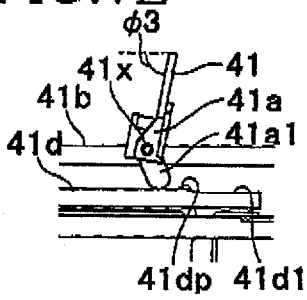
Figure 7F:
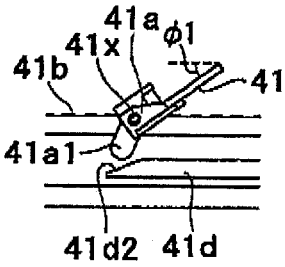
Figure 7G:
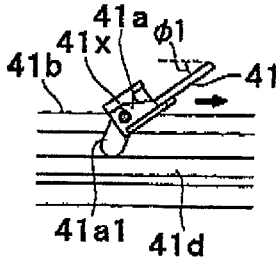

When the wiping is not performed, the first wiper 41 is positioned at the home position (that is the position located on one side of the conveyance belt 8 in its widthwise direction in FIG. 5). In this home position, the first wiper 41 is opposed to the face 8*a* in a vertical direction and is at rest at an angle φ1 with respect to the horizontal plane such that the distal end of the first wiper 41 does not contact the face 8*a*. When the first wiper 41 is to move from the home position in the main scanning direction by the motor 41M, as shown in FIGS. 7B, 7C, and 7D, the lower end 41*a*1 pivots or rotates while contacting an inclined face of the protruding portion 41*dp* near the step face 41*d*1. In this operation, the first wiper 41 pivots or rotates about the shaft 41*x* against an urging force of the urging member, whereby the angle of the first wiper 41 with respect to the horizontal plane is changed from $\phi$1 to $\phi$2 and then $\phi$3 ($\phi$1<$\phi$2<$\phi$3). As a result, the distal end of the first wiper 41 is brought into contact with the face 8*a*. Then, as shown in FIGS. 7D and 7E, the lower end 41*a*1 is moved over the protruding portion 41*dp*, and the first wiper 41 moves in the main scanning direction while keeping the angle $\phi$3 to perform the wiping. During the wiping, the urging force of the urging member (i.e., a force in a direction directed so as to change the first wiper 41 from the angle $\phi$2 to the angle $\phi$1) is applied to the first wiper 41, but the first wiper 41 is kept at the angle $\phi$3 because the lower end 41*a*1 is supported on the face of the plate 41*d*. When the first wiper 41 has reached the other end of the plate 41*d* in the main scanning direction, and the lower end 41*a*1 has reached the inclined face 41*d*2, as shown in FIG. 7F, the lower end 41*a*1 is released or disengaged from the face of the plate 41*d* (the inclined face 41*d*2). In accordance with this operation, the first wiper 41 pivots or rotates about the shaft 41*x* by the urging force of the urging member, whereby the angle of the first wiper 41 is changed from $\phi$3 to $\phi$2 and then $\phi$1. As a result, the distal end of the first wiper 41 is released or disengaged from the face 8*a*, and the wiping of the first wiper 41 is completed. After the wiping, the first wiper 41 is moved in the main scanning direction (specifically in a direction in the wiping) at the angle $\phi$1 to a position at which the distal end is brought into contact with the first wiper cleaner 44 (see FIG. 6). After the first wiper cleaner 44 has cleaned the distal end, the first wiper 41 is moved at the angle $\phi$1 in a direction opposite to the direction in the wiping (see FIG. 7G) to return to the home position. It is noted that, in the wiping, the first wiper 41 is moved in the main scanning direction from the one end to the other end of the conveyance belt 8 in its widthwise direction in the state in which the distal end is held in contact with the first area 8*a*1 while being deformed. In this operation, the first wiper 41 overlaps with or is overlaid on an entirety of the first area 8*a*1 in the sub-scanning direction. As a result, the foreign matters on the entire first area 8*a*1 are removed.

When the wiping is not performed, the second wiper 42 is held at a position distant from the conveyance belt 8. During the wiping, the second wiper 42 is slightly pivoted or rotated about the shaft 42*x*, whereby the distal end thereof is held at a position at which the distal end contacts the second area 8*a*2 while being deformed. In this position, the second wiper 42 is held in contact with an entire width of the second area 8*a*2 and inclined with respect to the face 8*a* as seen in the main scanning direction such that a lower portion of the second wiper 42 is located on a downstream side (on a right side in FIG. 1) of the distal end portion thereof in a relative-movement direction in which the second wiper 42 is moved relative to the face 8*a* during its wiping. As in the present embodiment, where the second wiper 42 is stopped or at rest, and the conveyance belt 8 is moved, the relative movement direction is a direction opposite to a belt running direction of the conveyance belt 8 in which the conveyance belt 8 runs or is circulated. Where the conveyance belt 8 is stopped or at rest, and the second wiper 42 is moved, the relative movement direction coincides with a direction of the movement of the second wiper 42. Where the conveyance belt 8 is moved, and the wiper 42 is moved in a direction opposite to the belt running direction of the conveyance belt 8, the relative movement direction coincides with the direction of the movement of the second wiper 42. The conveyance belt 8 runs in this state, whereby the foreign matters on the second area 8*a*2 are removed. After the wiping, the second wiper 42 is slightly pivoted or rotated about the shaft 42*x* to be released or disengaged from the conveyance belt 8.

The foreign matters removed by the wipings of the wipers 41, 42 are received by respective receiving trays, not shown, located below the respective wipers 41, 42.

The wipers 41, 42 and components for supporting the wiper cleaners 44, 45 (such as the bars 41*b* and the shafts 42; 44*x*, 45*x*) are supported by a frame 50 movable upward and downward relative to the casing 1*a*. Teeth 50*t* meshable with teeth of a gear 50*g* are formed on an end face of a one-side face of the frame 50. When the gear 50*g* is rotated forwardly or reversely by a motor 50M, the frame 50 is moved upward or downward in the vertical direction. As a result, the wipers 41, 42 and the wiper cleaners 44, 45 are moved upward and downward in the vertical direction while being supported by the bars 41*b* and the shafts 42*x*, 44*x*, 45*x*.

Figure 8:
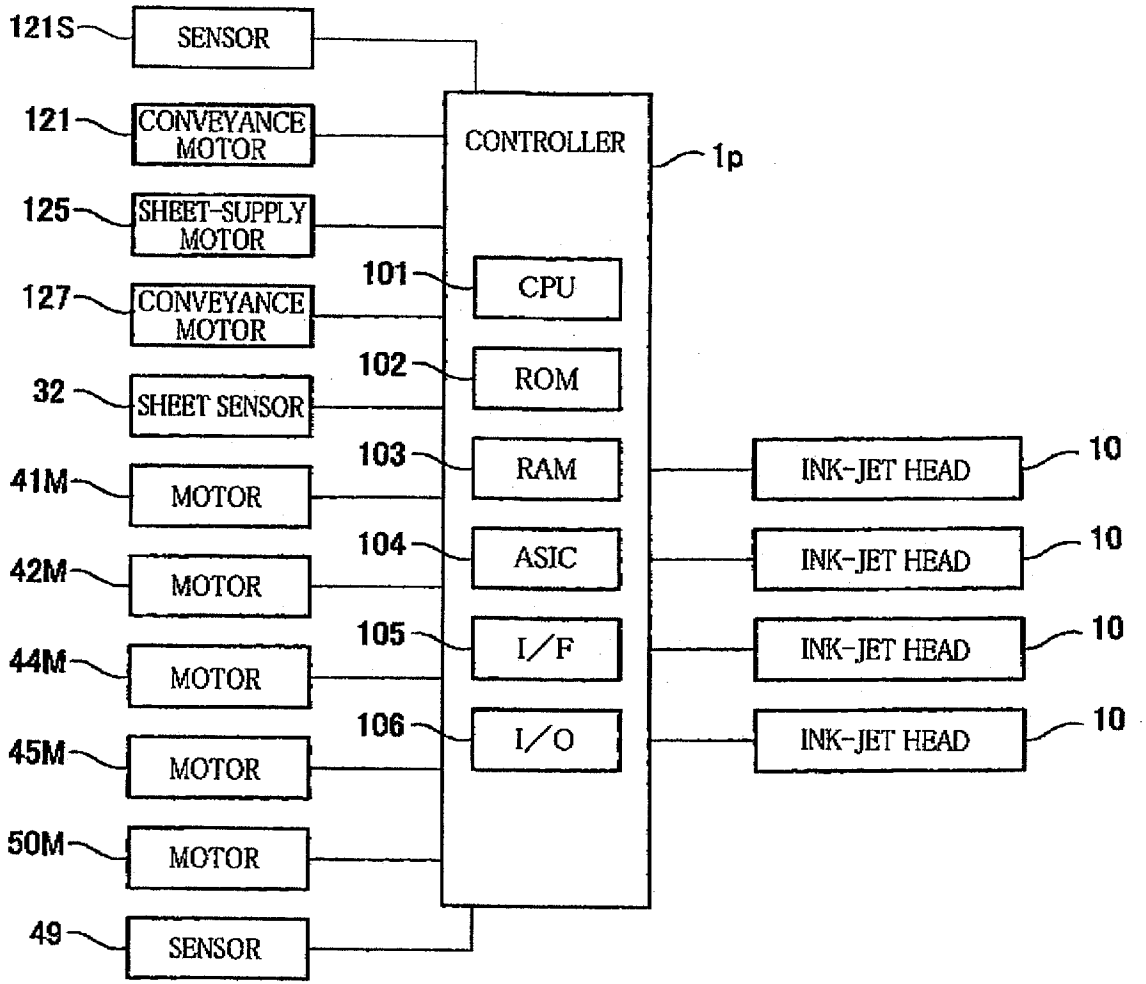
FIG. 8 is a block diagram showing an electric configuration of the printer in FIG. 1.

There will be next explained an electric configuration of the printer 1 with reference to FIG. 8.

As shown in FIG. 8, the controller 1*p* includes a Central Processing Unit (CPU) 101 as an arithmetic processing unit, a Read Only Memory (ROM) 102, a Random Access Memory (RAM) 103 such as a nonvolatile RAM, an Application Specific Integrated Circuit (ASIC) 104, an interface (I/F) 105, an Input/Output Port (I/O) 106, and so on. The ROM 102 stores therein programs executed by the CPU, various fixed data, and so on. The RAM 103 temporarily stores therein data (such as image data for the image recording on the sheet P) required for the execution of the programs. The ASIC 104 performs, e.g., rewriting and sorting of the image data, a signal processing, an image processing, and so on. The I/F 105 transmits or receives data to or from the external device. The I/O 106 inputs or outputs detection signals of various sensors.

The controller 1*p* is connected to the motors 121, 125, 127, 41M, 42M, 44M, 45M, 50M, the sensors 32, 49, a sensor 121S, the control boards of the respective heads 10, and so on. It is noted that the sensor 121S is a sensor that detects a rotational amount of the conveyance motor 121 and detects a moving (circulating) amount of the conveyance belt 8 (i.e., the conveyance amount of the conveyance belt 8 by the conveyance motor 121) on the basis of the detected rotational amount of the conveyance motor 121. The sensor 121S is disposed near a rotational portion of the conveyance motor 121. It is noted that, in addition to or instead of the sensor 121S, a sensor capable of directly detecting the moving amount of the conveyance belt 8 may be disposed near the conveyance belt 8 to detect the moving amount of the conveyance belt 8.

Figure 9:
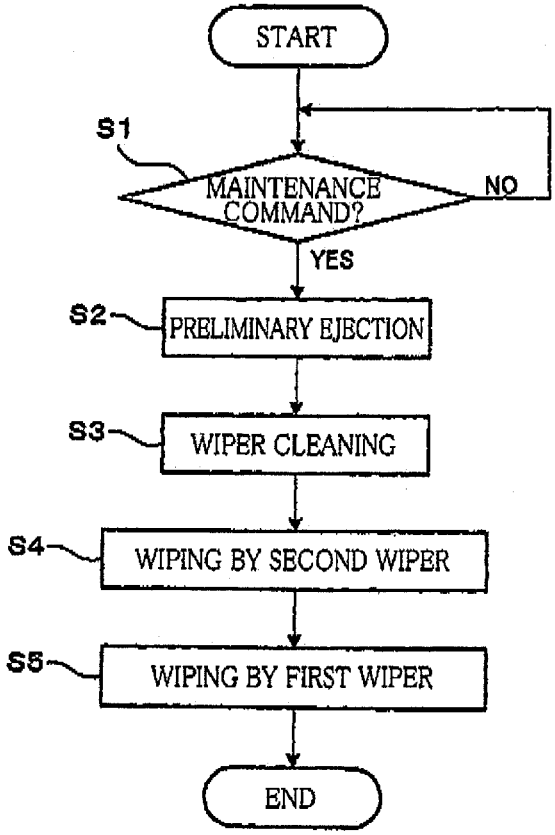
FIG. 9 is a flow-chart showing a control for a maintenance operation executed by a controller of the printer in FIG. 1.

There will be next explained processings for the maintenance operation executed by the controller 1*p* with reference to FIG. 9. The following processings are executed by the CPU 101 in accordance with the program stored in the ROM 102.

In S1, the controller 1*p* judges whether the controller 1*p* has received a maintenance command or not. The controller 1*p* receives the maintenance command in the following cases: (i) after the printer 1 is turned on; (ii) when a jamming of the sheet P occurs in the sheet conveyance path in the casing 1*a*; (iii) after the recording is completed on a predetermined number of the sheets P in successive recording and before the recording starts to be performed on the next sheet P; (iv) when no recording command has not been received for equal to or longer than a predetermined length of time after the recording has been completed on the basis of the recording command; and the like.

When the controller 1*p* has received the maintenance command (S1: YES), the controller 1*p* in S2 controls the components of the printer 1 to perform the preliminary ejection. The preliminary ejection is ejection of the ink from the head 10 onto the first area 8*a*1 of the face 8*a* of the conveyance belt 8, and the preliminary ejection includes purging (that is an operation for driving a pump so as to apply a pressure to the ink in the head 10 to eject the ink from the ejection openings 14*a*) and flushing (that is an operation for driving the actuators of the head 10 on the basis of flushing data (different from the image data) to eject the ink from the ejection openings 14*a*). It is noted that the preliminary ejection is the ejection that is not based on the image data for recording the image on the sheet P and that is the ejection performed preliminarily for the ejection onto the sheet P on the basis of the image data. The preliminary ejection is performed prior to the ejection onto the sheet P on the basis of the image data or during intervals between the plurality of the ejections onto the sheets P on the basis of the image data. Whether the head 10 performs the purging or the flushing in S2 is determined depending upon a situation. For example, the purging is performed in the above-described cases (i), (ii), and (iv), and the flushing is performed in the above-described case (iii). In this operation, the controller 1*p* controls the conveyance motor 121 to circulate the conveyance belt 8 and detects or senses the first area 8*a*1 on the basis of the signal transmitted from the sensor 49 to stop the conveyance belt 8 at a timing when the first area 8*a*1 faces the ejection face 10*a*. The controller 1*p* then drives the pump or the actuators to eject the ink from the head 10 onto the first area 8*a*1. The controller 1*p* executes these controls for each head 10.

After S2, the controller 1*p* in S3 performs the wiper cleaning for cleaning the distal end of the second wiper 42. In this cleaning, the controller 1*p* drives the motor 42M in a state in which the conveyance belt 8 is stopped, and then rotates the second wiper 42 by 360 degrees about the shaft 42*x* in the clockwise direction in FIG. 1. In this rotation, the distal end of the second wiper 42 is held in contact with an outer circumferential face of the second wiper cleaner 45 while being deformed. As a result, the foreign matters exist on the distal end of the second wiper 42 are attached onto the second wiper cleaner 45 and removed from the distal end of the second wiper 42.

After S3, the controller 1*p* in S4 controls the components of the printer 1 to perform the wiping of the second wiper 42. In this operation, the controller 1*p* controls the conveyance motor 121 to circulate the conveyance belt 8 and detects or senses the first area 8*a*1 on the basis of the signal transmitted from the sensor 49. The controller 1*p* then stops the conveyance belt 8 at a timing when a downstream portion X (see FIG. 5) of the first area 8*a*1 that is located on a downstream side of a center O of the first area 8*a*1 in the relative-movement direction is positioned on an upper side of the distal end of the second wiper 42 (noted that the center O is a center of the first area 8*a*1 in the circumferential direction of the conveyance belt 8). Specifically, on the basis of the output of the sensor 121S, the controller 1*p* calculates the conveyance amount (the moving amount) of the conveyance belt 8 from a timing when the sensor 49 has detected an end portion of the first area 8*a*1 (i.e., an upstream end portion in the relative-movement direction that is near a boundary between a portion Y of the first area 8*a*1 and the second area 8*a*2), and stops the conveyance belt 8 after the first area 8*a*1 is positioned on an upper side of the distal end of the second wiper 42, and then the center O of the first area 8*a*1 in the circumferential direction has passed through a position on an upper side of the distal end of the second wiper 42. The controller 1*p* then drives the motor 50M to move the frame 50 upward and drives the motor 42M to rotate the second wiper 42. As a result, the distal end of the second wiper 42 positioned distant from the face 8*a* is brought into contact with the downstream portion X of the first area 8*a*1. The controller 1*p* stops the motor 42M at a timing when the distal end of the second wiper 42 is brought into contact with the portion X while being deformed. The controller 1*p* then drives the conveyance motor 121 again to circulate the conveyance belt 8. The controller 1*p* stops the conveyance belt 8 at a timing before the conveyance belt 8 has been circulated by a single circulation after the second wiper 42 has been brought into contact with the portion X and at a timing when the distal end of the second wiper 42 has reached the portion Y (see FIG. 5) that is located on an upstream side of the center O of the first area 8*a*1 in the relative-movement direction. Specifically, on the basis of the output of the sensor 121S, the controller 1*p* calculates the conveyance amount (the moving amount) of the conveyance belt 8 from a timing when the distal end of the second wiper 42 is brought into contact with the portion X of the first area 8*a*1, and stops the conveyance belt 8 before the first area 8*a*1 is brought into contact with the distal end of the second wiper 42, and the center O of the first area 8*a*1 in the circumferential direction passes through the distal end of the second wiper 42. That is, the controller 1*p* controls the second wiper 42 and the conveyance belt 8 such that the second wiper wipes the face 8*a* so as to move without moving through the center O when the second wiper 42 wipes the first area 8*a*1 before the wiping of the second area 8*a*2, and so as to move from the other end portion of the first area 8*a*1 to a position on the first area 8*a*1, which position is located on an opposite side of the center O from the one end portion when the second wiper 42 wipes the first area 8*a*1 after the wiping of the second area 8*a*2. The controller 1*p* then drives the motor 42M to slightly pivot or rotate the second wiper 42 about the shaft 42*x* to release or disengage the second wiper 42 from the portion Y of the first area 8*a*1.

In S4, the controller 1*p* determines a release position (a position on the portion Y) at which the second wiper 42 is released from the face 8*a* at a timing when the wiping of the second wiper 42 is completed, on the basis of an amount of the foreign matters held on the second wiper 42 at the timing when the wiping of the second wiper 42 is completed. For example, the larger the amount of the foreign matters held on the second wiper at the completion of the wiping of the second wiper 42, the nearer to the upstream side in the relative-movement direction the above-described release position is determined in the portion Y. Specifically, the controller 1*p* estimates the amount of the foreign matters held on the second wiper 42 at the timing of the completion of the wiping of the second wiper 42, on the basis of an amount of the ink attached on the face 8*a*, in other words, an amount of the ink ejected from the head 10. That is, where the purging is performed in S2, the controller 1*p* judges that the amount of the foreign matters held on the second wiper 42 at the timing of the completion of the wiping of the second wiper 42 is large. On the other hand, where the flushing is performed in S2, the controller 1*p* judges that the amount of the foreign matters held on the second wiper 42 at the timing of the completion of the wiping of the second wiper 42 is small. In the present embodiment, the release position of the second wiper 42 released from the face 8*a* at the timing of the completion of the wiping of the second wiper 42 is located nearer to the upstream side in the portion Y in the relative-movement direction where the purging is performed in S2 than where the flushing is performed in S2.

Figure 10:
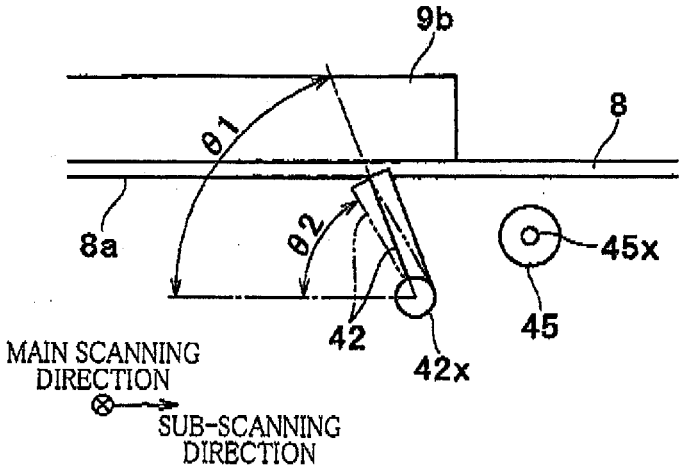
FIG. 10 is a partial view for explaining an adjustment of a pressure applied to a face of the conveyance belt by a second wiper.

Since the contact position at which the second wiper 42 contacts the face 8*a* at the start of S4 is on the portion X, and the release position at which the second wiper 42 is released from the face 8*a* at the end of S4 is on the portion Y, the second wiper 42 wipes the entire second area 8*a*2 and a portion of the first area 8*a*1. Here, the controller 1*p* controls the second wiper 42 to make a pressure of the second wiper 42 onto the face 8*a* smaller in a situation where the second wiper 42 contacts the first area 8*a*1 than in a situation where the second wiper 42 contacts the second area 8*a*2. The pressure per a unit area is calculated by an expression "Q/S" (the sign "Q" represents a force applied to a portion of the face 8*a* which is contacted by the second wiper 42, the sign "S" represents an area of the portion of the face 8*a* which is contacted by the second wiper 42, and calculated by an expression "l*d", the sign "l" represents a length of the portion of the face 8*a* which is contacted by the second wiper 42 in the widthwise direction of the conveyance belt 8 (i.e., the width, of the conveyance belt 8 in the present embodiment), and the sign "d" represents a length of the portion of the face 8*a* which is contacted by the second wiper 42 in the circumferential direction of the conveyance belt 8 (i.e., a length of a deformed portion of the distal end of the second wiper 42)). In the present embodiment, the angle of the second wiper 42 with respect to the face 8*a* is adjusted by the control of the motor 42M. For example, as shown in FIG. 10, the angles θ1, θ2 of the second wiper 42 with respect to the horizontal plane parallel to the face 8*a* are changed. In this example, the angle θ1 is larger than the angle θ2 (θ1>θ2), and an amount of the deformation of the distal end of the second wiper 42 is smaller in the case of the angle θ2 than in the case of the angle θ1 and thus the above-described pressure is smaller in the case of the angle θ2 than in the case of the angle θ1.

After S4, the controller 1*p* in S5 controls the components of the printer 1 to perform the wiping of the first wiper 41. In this wiping, the controller 1*p* controls the conveyance motor 121 to circulate the conveyance belt 8 and then to stop the conveyance belt 8 at a timing when the entire first area 8*a*1 reaches the wiping area of the first wiper 41 (that is, when the state shown in FIG. 5 is established). Specifically, a leading end portion of the first area 8*a*1 in the belt running direction is located on an upstream side of a downstream end portion of the first wiper 41 in the belt running direction, and a trailing end portion of the first area 8*a*1 in the belt running direction is located on a downstream side of an upstream end portion of the first wiper 41 in the belt running direction. The controller 1*p* then drives the motor 41M to move the first wiper 41 in the main scanning direction (i.e., in a direction indicated by bold arrow in FIG. 5). As described above, the first wiper 41 having reached the other end of the conveyance belt 8 in its widthwise direction returns to the home position after the distal end of the first wiper 41 is cleaned by the first wiper cleaner 44. In S5, the first wiper 41 wipes the entire first area 8*a*1.

After S5, the controller 1*p* finishes the control for the maintenance operation.

It is noted that the controller 1*p* drives the motors 44M, 45M to rotate the wiper cleaners 44, 45 by a predetermined angle smaller than 360 degrees each time when one or a plurality of times of the wiper cleanings for the wiper cleaners 44, 45 is or are finished. As a result, portions of the wiper cleaners 44, 45 which are contacted by the distal ends of the respective wipers 41, 42 during the wiper cleaning are changed, making it possible to effectively remove the foreign matters attached on the distal ends of the respective wipers 41, 42.

As described above, in the printer 1 and the conveyance belt 8 as the present embodiment, the grinding marks 8*b*1 (see FIG. 5) extending in the widthwise direction of the conveyance belt 8 (that is, in a direction in which the first wiper 41 is moved relative to the face 8*a*) are formed in the first area 8*a*1 to be wiped by the first wiper 41. As a result, it is possible to reduce a problem that good wiping cannot be performed during the wiping of the first wiper 41 because the foreign matters enter into the grinding marks 8*b*1. Accordingly, in the present embodiment, the first wiper 41 is moved relative to the face 8*a* of the annular conveyance belt 8 in the direction intersecting the circumferential direction of the conveyance belt 8, making it possible to perform the good wiping.

It is noted that, where the entire face 8*a* of the conveyance belt 8 is set as the first area 8*a*1 (i.e., the area in which the grinding marks 8*b*1 extending in the widthwise direction of the conveyance belt 8 are formed), a work for the grinding step may be complicated, which may cause a higher manufacturing cost. However, in the present embodiment, a part of the face 8*a* of the conveyance belt 8 is set as the first area 8*a*1, making it possible to perform the good wiping while suppressing the complication of the grinding step.

Further, in the present embodiment, as shown in FIG. 9, an ejection property can be recovered by performing the preliminary ejection in S2 (the purging or the flushing) onto the first area 8*a*1. Further, after the preliminary ejection in S2, the ink ejected onto the first area 8*a*1 is wiped by the first wiper 41 (in S5).

As shown in FIG. 5, the first wiper 41 is longer than the first area 8*a*1 in the sub-scanning direction. As a result, it is possible for the first wiper 41 to contact the entire width of the first area 8*a*1 during the wiping of the first wiper 41. Accordingly, the wiping of the first wiper 41 can be performed efficiently.

The grinding marks 8*b*2 extending in the circumferential direction of the conveyance belt 8 are formed in the second area 8*a*2 that is the area of the face 8*a* of the conveyance belt 8 except the first area 8*a*1. The printer 1 includes the second wiper 42 that is moved relative to the face 8*a* in the circumferential direction of the conveyance belt 8. As a result, the face 8*a* of the conveyance belt 8 can be cleaned by performing the wiping of the second area 8*a*2 by the second wiper 42 in addition to the wiping of the first area 8*a*1 by the first wiper 41.

As shown in FIG. 9, the controller 1*p* controls the second wiper 42 and the conveyance belt 8 such that the wiping in S4 by the second wiper 42 is performed prior to the wiping in S5 by the first wiper 41 and such that the second wiper 42 is released from the face 8*a* at the first area 8*a*1 at the timing of the completion of the wiping of the second wiper 42. As a result, the foreign matters held on the second wiper 42 at the completion of the wiping of the second wiper 42 remain on the first area 8*a*1, and these foreign matters can be removed by the wiping in S5 by the first wiper 41. Accordingly, an effective wiping can be performed.

The controller 1*p* controls the second wiper 42 such that, at the completion of the wiping in S4 by the second wiper 42, the second wiper 42 is released from the face 8*a* at the portion Y in FIG. 5 on an upstream side of the center O of the first area 8*a*1 in the relative-movement direction in which the second wiper 42 is moved relative to the face 8*a*. As a result, it is possible to prevent that the foreign matters held on the second wiper 42 at the completion of the wiping of the second wiper 42 are moved to an outside of the first area 8*a*1, thereby reliably removing the foreign matters in the wiping of the first wiper 41.

The controller 1*p* determines the release position at which the second wiper 42 is released from the face 8*a* at the timing when the wiping of the second wiper 42 in S4 is completed, on the basis of the amount of the foreign matters held on the second wiper 42 at the timing when the wiping of the second wiper 42 is completed. From the viewpoint of preventing that the foreign matters held on the second wiper 42 at the completion of the wiping of the second wiper 42 are moved to the outside of the first area 8*a*1, the above-described foreign matters are preferably left on the center O of the first area 8*a*1 in the circumferential direction of the conveyance belt 8 at the completion of the wiping of the second wiper 42. The foreign matters held on the second wiper 42 are located on a downstream side of the second wiper 42 in the relative-movement direction. Thus, for example, the larger the amount of the foreign matters held on the second wiper 42 at the completion of the wiping of the second wiper 42, the nearer to the upstream side in the relative-movement direction the release position is set on the first area 8*a*1 (on an upstream side of the center O of the first area 8*a*1 in the relative-movement direction). As a result, it is possible to reliably prevent that the foreign matters held on the second wiper 42 at the completion of the wiping of the second wiper 42 are moved to the outside of the first area 8*a*1.

The controller 1*p* controls the second wiper 42 and the conveyance belt 8 such that the wiper 42 is brought into contact with the face 8*a* on a downstream side of the center O of the first area 8*a*1 in the relative-movement direction (at the portion X in FIG. 5) at the start of the wiping in S4 by the second wiper 42. As a result, it is possible to reduce the amount of the foreign matters entering into the grinding marks SW on the first area 8*a*1 at the start of the wiping of the second wiper 42.

The controller 1*p* controls the second wiper 42 to make the pressure of the second wiper 42 onto the face 8*a* smaller in the situation where the second wiper 42 contacts the first area 8*a*1 than in the situation where the second wiper 42 contacts the second area 8*a*2. As a result, the foreign matters on the second area 8*a*2 can be reliably removed in the wiping in S4 by the second wiper 42, and the amount of the foreign matters entering into the grinding marks 8*b*1 in the first area 8*a*1 can be reduced.

The first area 8*a*1 and the second area 8*a*2 have the different surface roughnesses from each other, and the sensor 49 senses the first area 8*a*1 on the basis of the surface roughnesses. That is, where the first area 8*a*1 and the second area 8*a*2 have the different surface roughnesses from each other, the first area 8*a*1 and the second area 8*a*2 have different reflectivities from each other. The sensor 49 senses the first area 8*a*1 on the basis of a difference of the reflectivities due to the difference of the surface roughnesses of the first area 8*a*1 and the second area 8*a*2. This simple structure makes it possible to sense the first area 8*a*1 and perform accurate wiping.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

The conveyance member is not limited to the conveyance belt and may be a rotational drum, for example. The conveyance member does not need to be seamless as long as the conveyance member has the annular shape. The material forming the conveyance member is not limited in particular.

The direction in which the grinding marks formed in the first area extend is not limited to the direction perpendicular to the circumferential direction of the conveyance member as long as the direction in which the grinding marks formed in the first area extend coincides with the direction in which the first wiper is moved relative to the surface of the conveyance member. The direction in which the grinding marks formed in the second area extend is not limited in particular. Further, the grinding marks may not be formed in the second area. The first area and the second area may have the same surface roughness (in this case, the first area may be sensed on the basis of a hole formed in the conveyance member or a reflector plate mounted on the face of the conveyance member, for example). The sensor for sensing the first area is not limited to the optical sensor and may be a magnetic sensor, for example. The first area may have any length in the circumferential direction and in the widthwise direction of the conveyance member and may have any shape instead of the rectangular shape. It is noted that, the relationship between the lengths of the first area and the first wiper in the circumferential direction may be a relationship explained below. In the above-described embodiment, the length of the first wiper in the circumferential direction is larger than the length of the first area in the circumferential direction, but the present invention is not limited to this relationship. For example, the length of the first wiper in the circumferential direction may be smaller than the length of the first area in the circumferential direction. That is, the first wiper is configured so as to wipe at least a part of the first area (i.e., a part or an entire area of the first area), making it possible for the first wiper to remove the foreign matters collected by the second wiper into an area in the first area to be wiped by the first wiper. Further, in the above-described embodiment, the first area is formed so as to expand from the one end to the other end of the conveyance belt in its widthwise direction (i.e., in the main scanning direction) but may be formed so as to expand from a vicinity of the one end of the conveyance belt to a vicinity of the other end thereof in the widthwise direction of the conveyance belt.

Each of the first and the second wipers is not limited to have the plate shape as long as each wiper can wipe the face of the conveyance member by moving relative to the face while contacting the face, and each wiper may have any shape (e.g., a circular cylinder roller may be employed). The material forming the first and second wipers is not limited in particular. The direction in which the first wiper is moved relative to the face of the conveyance member may be any direction as long as the direction is an intersecting direction intersecting the circumferential direction of the conveyance member, and may not be the direction perpendicular to the circumferential direction of the conveyance member. The first wiper may have any length in a direction perpendicular to the intersecting direction and parallel to the first area (for example, the first wiper may be shorter than the first area). Further, the second wiper may be omitted.

After the preliminary ejection, only the wiping of the first wiper may be performed without the wiping of the second wiper. Further, in the above-described embodiment, the wiping is performed after the preliminary ejection (see FIG. 9), but the wiping is not limited to be performed after the preliminary ejection and may be performed at any timing.

In the wiping of each wiper, the wiper and the face of the conveyance member only need to move relatively to each other. That is, the face of the conveyance member may be moved in a state in which the wiper is at rest, and the wiper may be moved in a state in which the face of the conveyance member is at rest, and both of the wiper and the face of the conveyance member may be moved.

The contact position at which the second wiper contacts the face of the conveyance member at the start of the wiping of the second wiper and the release position at which the second wiper is released from the face of the conveyance member at the end of the wiping of the second wiper are not limited in particular (for example, each of the positions may be any position in the first area and may be any position in the second area). Further, the release position may not be determined on the basis of the amount of the foreign matters held on the second wiper at the completion of the wiping of the second wiper. Further, the wiping of the first area may be performed by the second wiper (for example, the conveyance member may be circulated by more than one circulation after the second wiper is brought into contact with the face of the conveyance member). Further, the pressure of the second wiper on the face of the conveyance member can be adjusted by a height of the second wiper in addition to the angle of the second wiper with respect to the face of the conveyance member. For example, the height of the second wiper may be changed or adjusted such that the amount of the deformation of the distal end of the second wiper is smaller (the above-described pressure is smaller) in a situation where the second wiper contacts the first area than in a situation where the second wiper contacts the second area. Further, such an adjustment of the pressure may not be performed.

The wiper cleaner may be a rotatable brush instead of the sponge, for example. Further, the wiper cleaner and the wiper cleaning using this may be omitted.

The present invention is applicable to any of a line printer and a serial printer. Further, the present invention is applicable to not only the printer but also another liquid ejection apparatus such as a facsimile machine and a copying machine. The present invention is also applicable to a recording apparatus configured to record an image by ejecting liquid other than the ink and is also applicable to a recording apparatus of a thermal type, a laser type, or the like.

The recording medium is not limited to the sheet P and may be various recording media.

What is claimed is:

1. A recording apparatus comprising:

a recording portion configured to record an image on a recording medium;

an annular conveyance member having a face opposed to the recording portion, the face being capable of moving in a circumferential direction of the annular conveyance member while supporting the recording medium to convey the recording medium;

a first wiper configured to wipe the face by moving relative to the face, while contacting the face, in an intersecting direction that intersects the circumferential direction;

a second wiper configured to wipe the face by moving relative to the face in the circumferential direction while contacting the face; and a second-wiper controlling section configured to control the second wiper, wherein the face has a first area as a part of the face, the first area being an area at least a part of which is configured to be wiped by the first wiper, the first area comprising a grinding mark extending in the intersecting direction, wherein the face has a second area as part of the face different from the first area, the second area being an area at least a part of which is configured to be wiped by the second wiper, the second area having a grinding mark extending in the circumferential direction, and wherein the second-wiper controlling section is configured to control the second wiper such that the wiping of the second wiper is performed before the wiping of the first wiper and such that a position at which the second wiper is released from the face when the wiping of the second wiper is completed is a position on the first area.

2. The recording apparatus according to claim 1, wherein the recording portion has an ejection face having an ejection opening formed therein for ejecting liquid, wherein the recording apparatus further comprises:

a preliminary-ejection controlling section configured to control the recording portion to perform a preliminary ejection for preliminarily ejecting the liquid from the ejection opening onto the first area when the first area faces the ejection face without the recording medium interposed therebetween; and a first-wiper controlling section configured to control at least one of the conveyance member and the first wiper to perform the wiping of the first wiper after the liquid is ejected onto the first area in the preliminary ejection.

3. The recording apparatus according to claim 1, wherein the first wiper has a length equal to or longer than that of the first area in a direction perpendicular to the intersecting direction and parallel to the first area.

4. The recording apparatus according to claim 1, wherein an entirety of the first area is comprised in an area of the face, which area is wiped by the first wiper.

5. The recording apparatus according to claim 1, wherein the second-wiper controlling section is configured to control the second wiper such that the position at which the second wiper is released from the face when the wiping of the second wiper is completed is a position located on an upstream side of a center of the first area in a relative-movement direction in which the second wiper is moved relative to the face, the center being a center of the first area in the circumferential direction.

6. The recording apparatus according to claim 5, further comprising a conveyance controlling section configured to control the conveyance member such that the face moves in the circumferential direction, wherein the conveyance controlling section is configured to stop the face in a state in which the second wiper is held in contact with the face, when the second wiper is located on the first area at a position on an upstream side of the center of the first area in the relative-movement direction.

7. The recording apparatus according to claim 1, wherein the second-wiper controlling section is configured to control the second wiper such that the second wiper wipes the first area from an end portion thereof without moving through a center of the first area in the circumferential direction when the second wiper wipes the first area after the wiping of the second area, the center being a center of the first area in the circumferential direction.

8. The recording apparatus according to claim 1, wherein the second-wiper controlling section is configured to determine the position at which the second wiper is released from the face after the wiping of the second wiper is completed, on the basis of an amount of foreign matters held on the second wiper when the wiping of the second wiper is completed.

9. The recording apparatus according to claim 1, wherein the second wiper controlling section is configured to control the second wiper such that a position at which the second wiper contacts the face when the wiping of the second wiper is started is a position on the first area.

10. The recording apparatus according to claim 9, wherein the second-wiper controlling section is configured to control the second wiper such that the position at which the second wiper contacts the face when the wiping of the second wiper is started is a position located on a downstream side of a center of the first area in a relative-movement direction in which the second wiper is moved relative to the face, the center being a center of the first area in the circumferential direction.

11. The recording apparatus according to claim 9, wherein the second-wiper controlling section is configured to control the second wiper such that the second wiper wipes the first area without moving through a center of the first area in the circumferential direction when the second wiper wipes the first area before the wiping of the second area.

12. The recording apparatus according to claim 10, further comprising a conveyance controlling section configured to control the conveyance member such that the face moves in the circumferential direction, wherein the conveyance controlling section is configured to stop the face in a state in which the second wiper is distant from the face, when the second wiper is located on the first area at a position on a downstream side of the center of the first area in the relative-movement direction.

13. The recording apparatus according to claim 1, wherein the second-wiper controlling section is configured to control the second wiper such that a pressure of the second wiper on the face when the second wiper contacts the first area is smaller than a pressure of the second wiper on the face when the second wiper contacts the second area.

14. The recording apparatus according to claim 1, wherein the first area and the second area have different surface roughnesses from each other, and wherein the recording apparatus further comprises a first-area sensing portion configured to sense the first area on the basis of a difference of the surface roughnesses.

15. The recording apparatus according to claim 1, wherein the circumferential direction coincides with a longitudinal direction of the conveyance member.

16. The recording apparatus according to claim 1, wherein the intersecting direction is a direction perpendicular to the circumferential direction.

* * * * *